US007192158B2

(12) United States Patent
Eppler

(10) Patent No.: US 7,192,158 B2
(45) Date of Patent: Mar. 20, 2007

(54) EXTENSIBLE MODULAR LUMINAIRE

(76) Inventor: Ross Robert Eppler, 800 College Ave., Santa Rosa, CA (US) 95404

( * ) Notice: Subject to any disclaimer, the term of this patent is extended or adjusted under 35 U.S.C. 154(b) by 0 days.

(21) Appl. No.: 10/897,209

(22) Filed: Jul. 22, 2004

(65) Prior Publication Data

US 2005/0047129 A1 Mar. 3, 2005

Related U.S. Application Data

(60) Provisional application No. 60/488,999, filed on Jul. 22, 2004.

(51) Int. Cl.
*F21S 4/00* (2006.01)

(52) U.S. Cl. ..... 362/219; 362/217; 362/221; 362/223; 362/225; 362/260

(58) Field of Classification Search ..... 362/217, 362/219, 221, 223, 225, 260
See application file for complete search history.

(56) References Cited

U.S. PATENT DOCUMENTS 5,171,085 A * 12/1992 Jaksich ..... 362/147
6,439,741 B1 * 8/2002 Diaz et al. ..... 362/217
2002/0001191 A1 * 1/2002 Grierson et al. ..... 362/219

* cited by examiner

*Primary Examiner*—Stephen F Husar
*Assistant Examiner*—Meghan K. Dunwiddie

(57) ABSTRACT

A linearly extensible modular luminaire comprised of mounting tracks (100,180) and translationally offset overlapping channels (211,212), with incorporated luminous means, alone or along with hangers (331,332,731) that provide support for cover brackets (431,731) that are attached to light modifying coverings (400,900), and wherein linearly radiated light is distributed directly, or in combination with coverings indirectly or modified, when connected with a source of power and energized. Also, the modular luminaire that is not extensible but otherwise comprised of same components not translationally offset, permitting the construction of a wide variety of luminaires, such as the one in FIG. 11, that incorporates a canopy (150) for mounting over lighting outlet boxes.

15 Claims, 16 Drawing Sheets

Figure 1a.
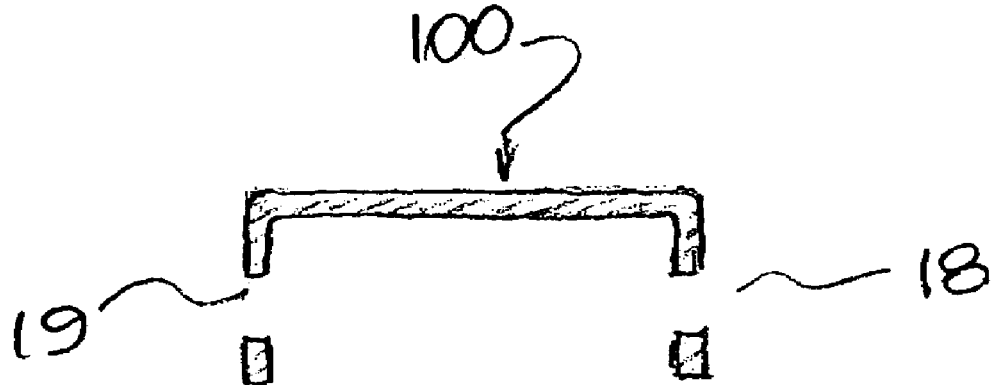
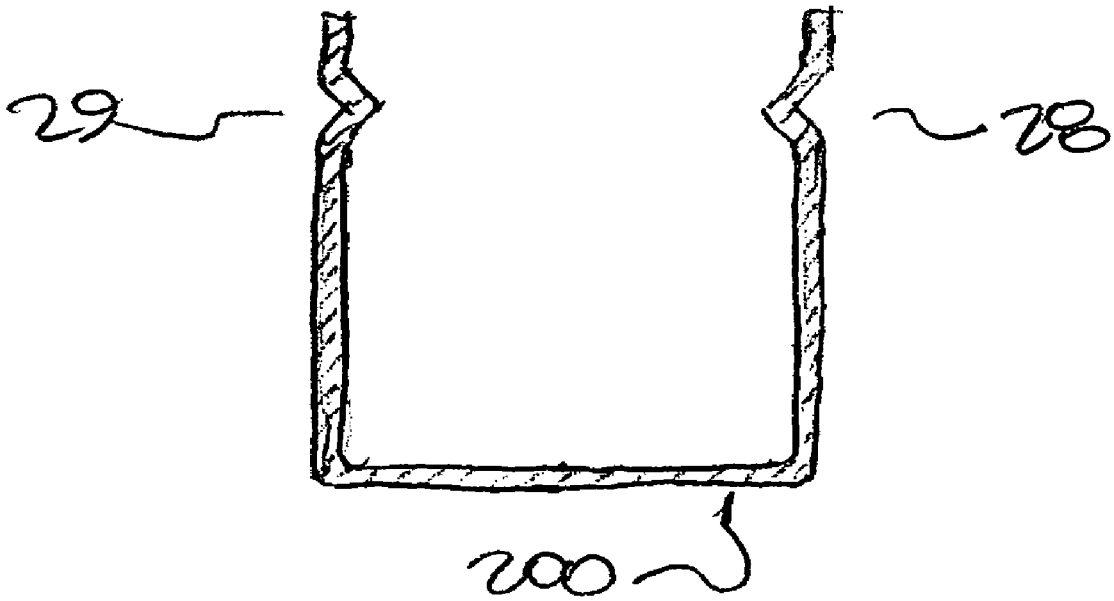
Figure 1b.

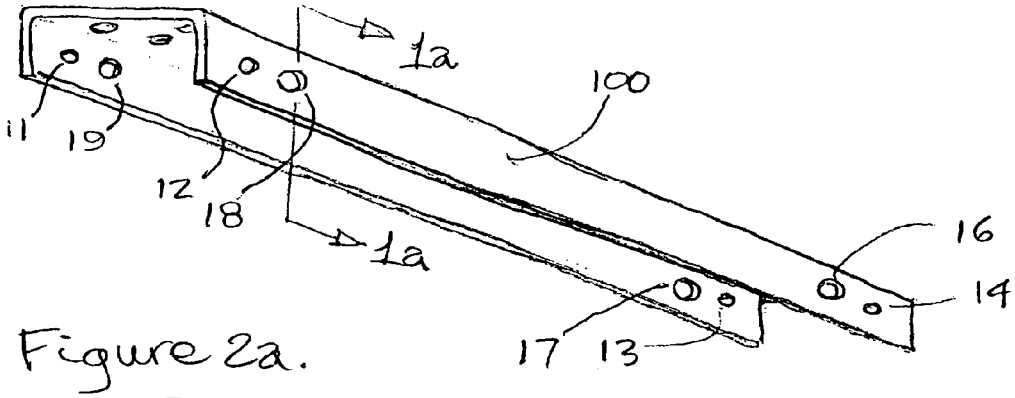
Figure 2a.
Figure 2b.
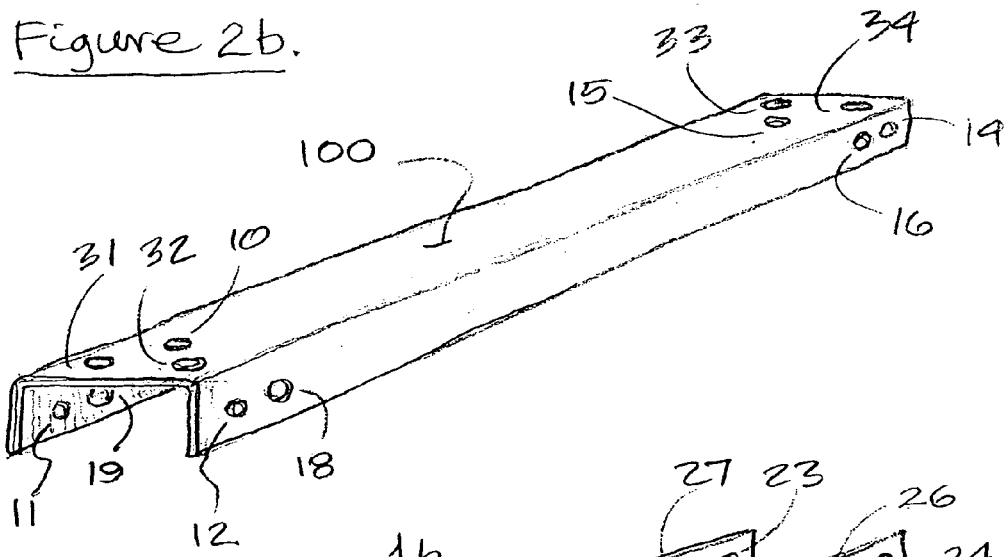
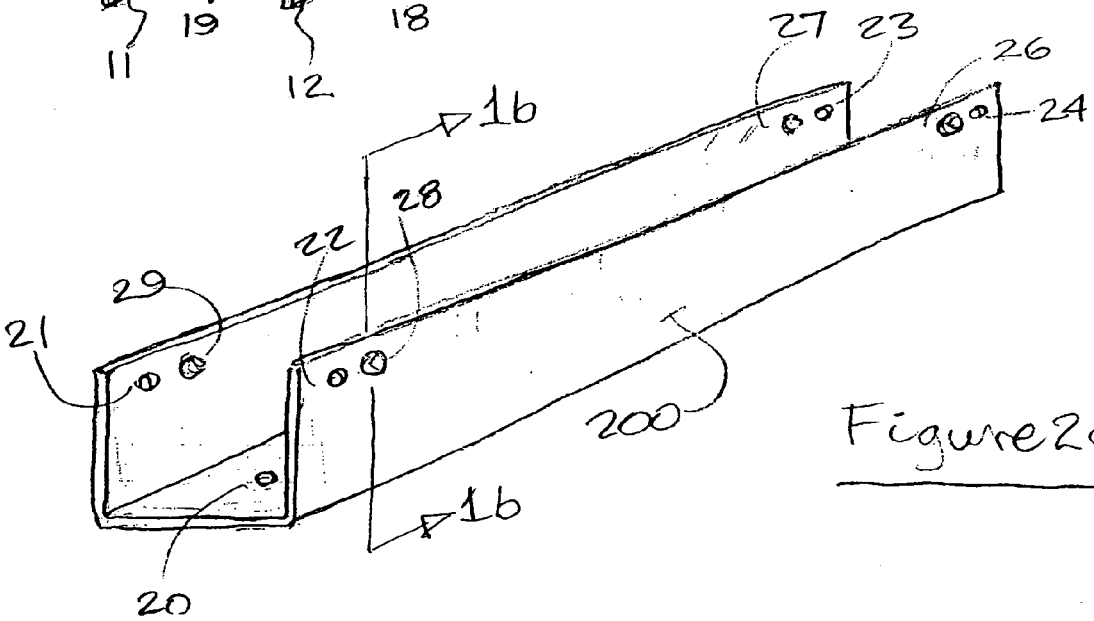
Figure 2c.

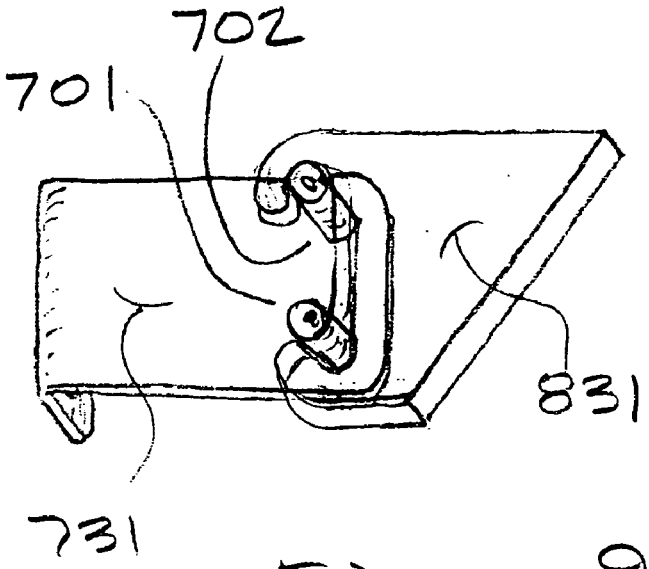
Figure 9a.
Figure 9b.
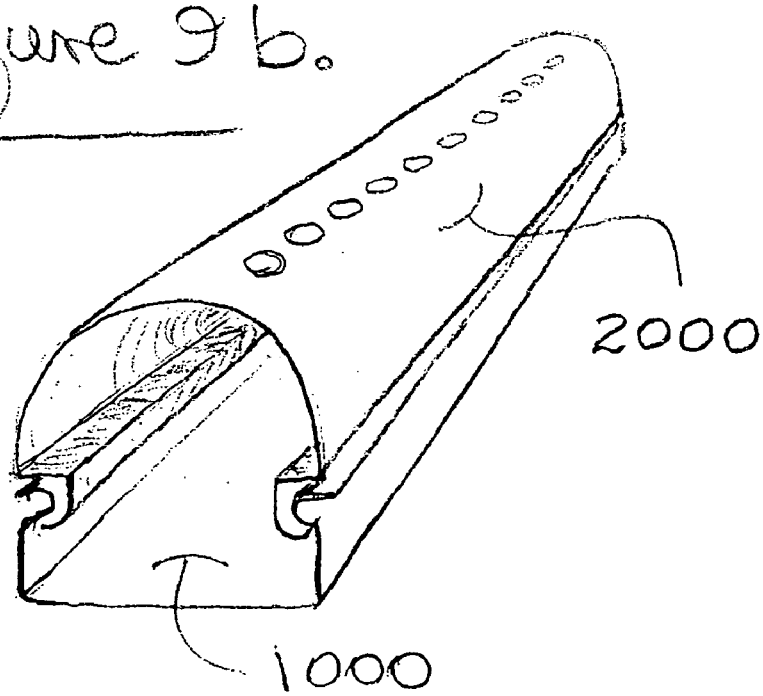

EXTENSIBLE MODULAR LUMINAIRE

CROSS-REFERENCE TO RELATED APPLICATIONS

The reader is directed to the Provisional Patent Application

File Number: 60/488999

Filing date 22 Jul. 2004

Titled Customizable Modular Luminaire

BACKGROUND OF THE INVENTION

After the invention of the light bulb, many innovators devised light sources, and luminaires for supporting and operating them, that produced light which radiated from an axis, rather than just a point. A variety of means for diffusing, reflecting, or altering the light from these sources were employed. Linear incandescent lamps persisted, but fluorescent tube lighting largely took over linear applications. Light emitting diodes used for indicators later were also used for illumination, including linearly.

Numerous types of housings supported the light source and energizing components. The fixture housing, type of light source, and light modifiers were wed by design. Energizing components had to be serviced in place, even when the luminaire was far from reach, or not readily accessible. Housings were bulky, heavy, and difficult to mount or install. Long rows of linear lighting made by assembling individual luminaire housings typically were crooked or challenged to remain straight.

A plethora of light modifying coverings mostly molded from plastic, or crafted from metal or wood, often had non-obvious means for removing and replacing coverings. It was difficult to replace lamps, and breakage of the cover was not uncommon. Coves or valences made for indirect lighting, hid the luminaires and lamps entirely from customary views, but this also made the lighting installation difficult and time consuming. Luminaires for indirect lighting that were suspended below a ceiling were arranged with components above the housing, limiting access to them.

BRIEF SUMMARY OF INVENTION

The present invention is directed generally to linear lighting systems, particularly where related to the installation of interior lighting in coves or valences, or as linear surface fixtures, and especially where modular design permits different arrangements of light sources, coverings, and distributions of light. The present invention comprises a modular, linearly extensible wireway for supporting lighting components, and separably supporting various or customized light modifying coverings.

OBJECTS AND ADVANTAGES

The present invention overcomes the drawbacks inherent in prior art, offering unique features that provide consumers, contractors, and designers with new ease of installation, and ability to customize appearance and function using standardized modular components.

An object and advantage of the present invention is to provide a linear luminaire that is easily installed and serviced, even when used in very small coves or suspended for indirect lighting.

A further object and advantage of the present invention is to provide a luminaire with an extensible housing that is substantially self-supporting when made extremely long relative to its cross-sectional size.

A further object and advantage of the present invention is to provide a luminaire with an extensible housing that remains straight or smoothly and gently curved over long spans.

Another object and advantage of the present invention is to provide a luminaire housing that permits energizing components to be readily separated from the part or parts of the housing that are mounted, suspended, or otherwise fixed in place.

A further object and advantage of the present invention is to provide a linear luminaire that can readily incorporate different light sources.

Another object and advantage of the present invention is to provide means for readily mounting linear luminaires over conventional electrical lighting outlets boxes without supplemental support or additional attachment of the housing to the structure or surface mounted over.

Another object and advantage of the present invention is to provide obvious means that allow for easy removal and replacement of light modifying coverings associated with a linear luminaire.

A further object and advantage of the present invention is to provide means to readily adapt various or custom light modifers for use with luminaire housings that are standardized modular constructions, and independent from their coverings, while also adaptively able to incorporate a variety of coverings with minimal overall change in design.

BRIEF DESCRIPTION OF THE DRAWINGS

FIG. 1*a* is an end sectional view of a basic track taken along the line 1*a*—1*a* of FIG. 2*a*.

FIG. 1*b* is an end sectional view of a basic channel taken along the line 1*b*—1*b* of FIG. 2*c*.

FIG. 2*a* is a view of a basic track from underneath and to its right.

FIG. 2*b* shows the same track from above and right.

FIG. 2*c* is a view of a basic channel from above and to its right.

FIG. 9*a* is a view of an alternate hanger with pegs and an isolated alternative cover bracket toward its front and from a little below.

FIG. 9*b* is a view of an alternate track and alternate channel made for a linear row of light emitting diodes as seen from above and to its right.

DETAILED DESCRIPTION

Basic Housing

Figure 3A:
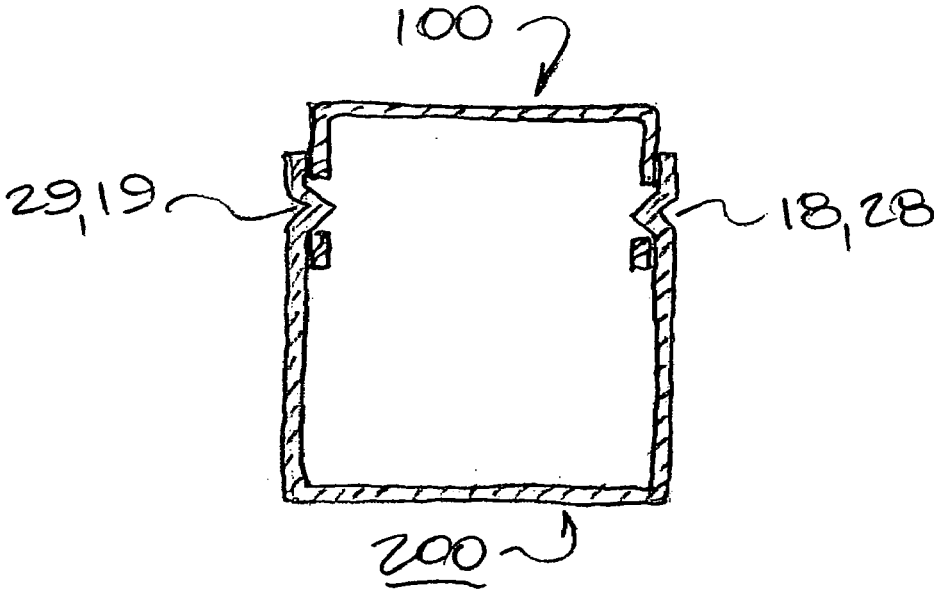
FIG. 3*a* is an end sectional view of a basic housing taken along the line 3*a*—3*a* of FIG. 4 and showing track and channel aligned.
Figure 3B:
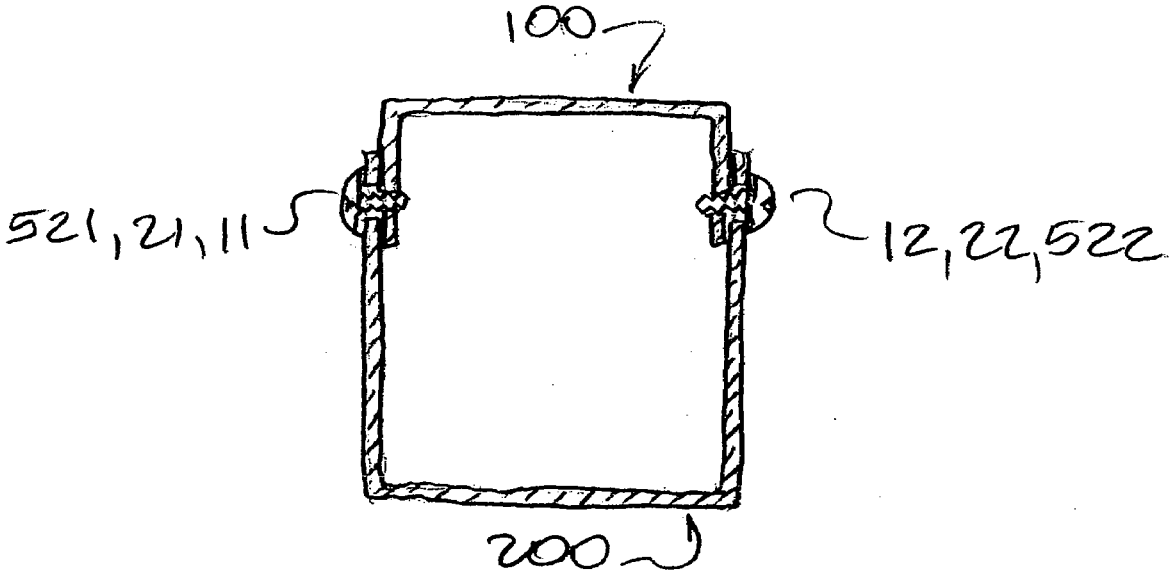
FIG. 3*b* is an end sectional view of basic housing taken along the line 3*b*—3*b* of FIG. 4 and showing track and channel fastened.
Figure 4:
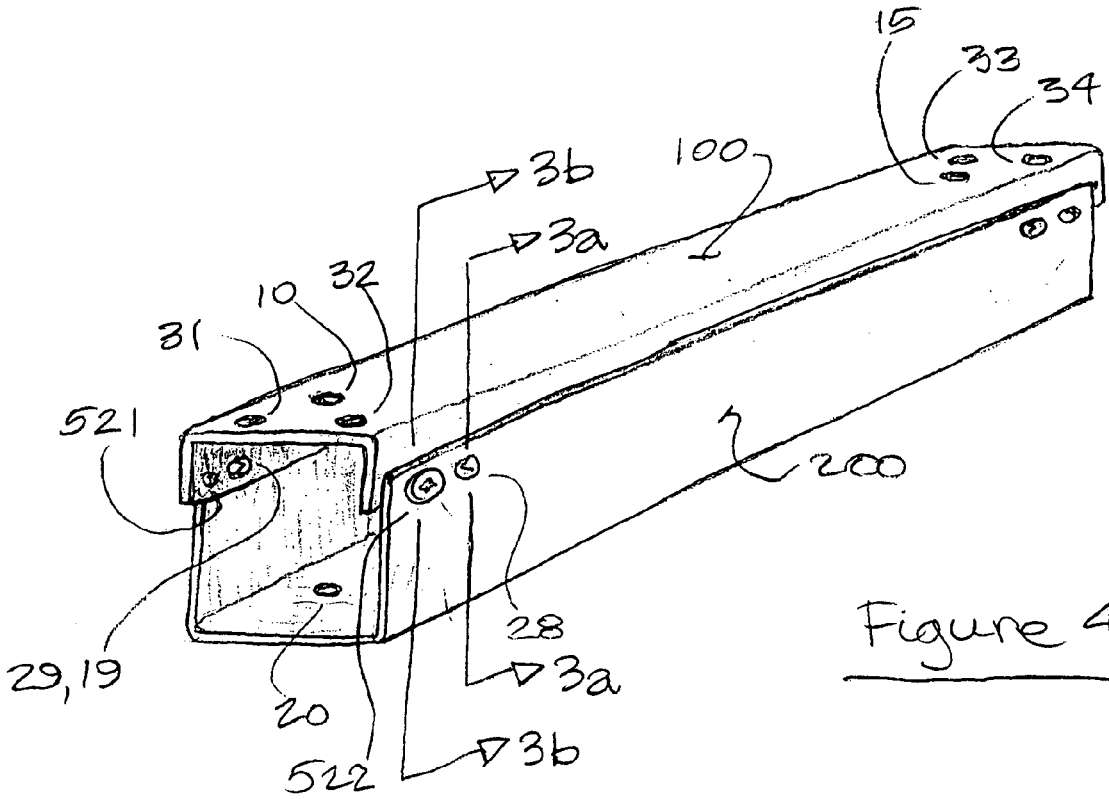
FIG. 4 is a view above and to right of a basic housing with interlocked track and channel.

FIGS. 1*a*, 1*b*, 2*a*, 2*b*, and 2*c*, show two parts that when assembled, comprise a luminaire housing, as shown in FIGS. 3*a*, 3*b*, and 4. An inverted-U-shaped basic mounting track (100), for mounting and supporting the assembled luminaire and supporting appendages, is shown in FIGS. 1*a*, 2*a*, and 2*b*. A similarly sized U-shaped basic channel (200), for supporting luminous components, is shown in FIGS. 1*b* and 2*c*. The track and channel lengths are much greater than their widths or heights. Both are substantially square-cornered. Both have thin walls made of material that is stiff, but not entirely rigid.

The track has two sides and a top, and the channel has two sides and a bottom. The track is narrower than the channel, and the channel is taller than the track. The inside distance between the lower edges of the sides of the channel is the same as the outside distance between the track's sides. The channels corners are formed to slightly less than ninety degree internal angles, therefore the upper edges of the channel's sides are spaced apart slightly less than this distance when not assembled with a track, and thus must be sprung open a little to engage the track.

With the two parts interlocked, as in FIGS. 3*a* and 4, their sides are partly overlapped, equally over their lengths. The lower edges of the track's sides are inside the upper edges of the channel's sides, and their lengths are centered relative to one another. Alignment dimples on the sides of the channel are engaged with alignment holes in the sides of the track; both are further described below. The closer end of the housing is shown fastened together with two joining screws (521,522), using the holes described below. Joining screws are self-threading with a wide binding head.

FIG. 4 also shows that the channel is slightly shorter than the track, which allows appendages, such as the hangers described below, to be attached to the track, and to close the ends of the housing, without increasing its length. When used with continuous-row housings, described below, the hangers are allowed to extend outside the space enclosed by the housing, by utilizing the gap formed between adjacent channels.

Basic Track

FIG. 2*a* shows two pairs of opposing alignment holes in the basic mounting track's sides, for engaging alignment dimples in the channel's sides, described below. One pair (18,19) is near the closer end of the track (100), and another pair (16,17) is near the farther end. All of the alignment holes are spaced equally above the track's lower edges. Each alignment hole is also spaced equally away from the end of the track to which it is nearest.

FIG. 2*a* also shows two pairs of opposing screw-capture holes in the track's sides for securing the track (100) and channel (200) together. One pair (11,12) is near the closer end and the other (13,14) near the farther end. Screw-capture holes are slightly smaller than the outer thread diameter of joining screws, and sized to secure screws driven into them. They are all spaced equally above the track's lower edges. Each screw-capture hole is also spaced equally away from the end of the track to which it is nearest, and each is closer to that end than is its adjacent alignment hole.

There are also pairs of screw-capture holes in the top of the mounting track (100) for fastening appendages, such as hangers, described below. FIGS. 2*b* and 4 show a pair of holes (31,32) near the closer end, and another pair (33,34) near the farther end of track. Each hole is spaced equally away from the end of the track to which it is nearest. The space between each pair of holes is also an equal amount, and each pair is centered in the width of the top of the track.

In addition, two single screw-capture holes (10,15) are centered in the width of the top of the track; one near each end, for other uses. Each single hole is spaced equally away from the end of the track to which it is nearest, and each is farther from that end, than is the pair of screw-capture holes in the top of the track, near that same end.

Basic Channel

As depicted in FIGS. 1*b* and 2*c*, at the closer end of the basic channel (200), and near the upper edges of its sides, a pair of conical-shaped alignment dimples (28,29), point inward, toward one another, from opposite sides of the channel. There is another identical pair of alignment dimples (26,27) at the farther end of the channel, shown in FIG. 2*c*.

The center of each dimple is spaced equally away from the end of the channel to which it is nearest, and they are all spaced equally below the upper edges of the sides of the channel. The center-to-center distance from the closer pair of alignment dimples (26,27) to the farther pair (28,29) on the sides of the channel (200), is the same as the center-to-center distance from the closer pair of alignment holes (16,17) to the farther pair (18,19) in the sides of the track (100).

The outer diameter at the base of any alignment dimple is slightly less than the diameter of any alignment hole. In FIGS. 3*a* and 4, near the closer end of the housing, the pairs of dimples and alignment holes are shown engaged (hole 18 is not shown in FIG. 4; it is behind the closer side of the channel).

FIGS. 3*b* and 2*c* show that the channel (200) also has a pair of opposing screw-locating holes (21,22), near the upper edges in its sides, and near the closer end. Another identical pair (23,24), near the farther end, is shown in FIG. 2*c*. They are all spaced equally below the channel's upper edges. Each hole is also spaced equally away from the end of the channel to which each is nearest.

The center-to-center distance from the closer pair of screw-locating holes in the channel (21,22) to the farther pair (23,24), is the same as the center-to-center distance from the closer pair of screw-capture holes to the farther pair in the track (respectively 11,12 and 13,14 shown in FIG. 2*a*). Screw-locating holes are smaller than the head of a joining screw, but larger than its outer thread diameter.

Figure 8A:
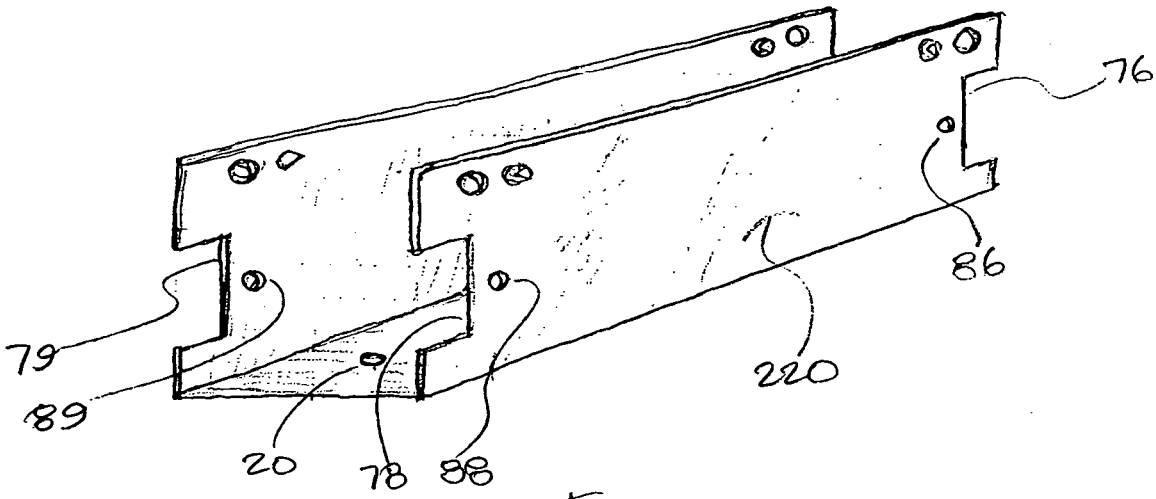
FIG. 8*a* is a view a little above and to the right of a two-lamp channel showing socket slots in its sides.
Figure 8B:
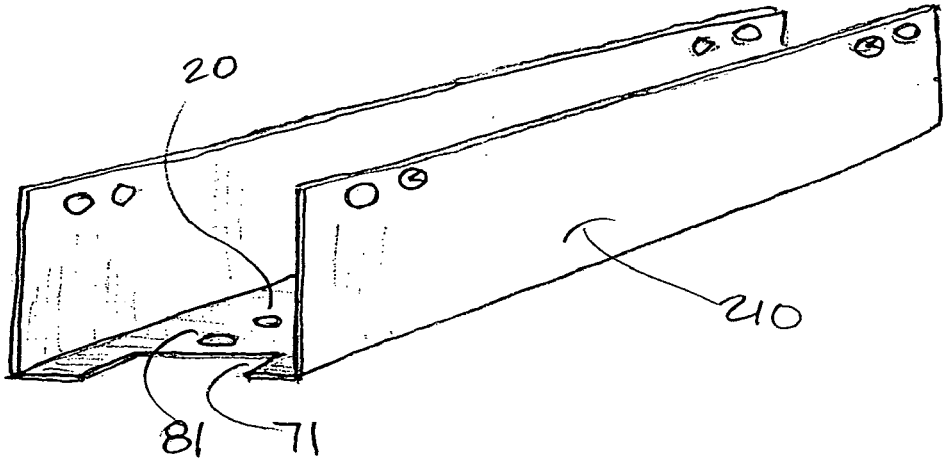
FIG. 8*b* is a similar view of a one-lamp channel showing a socket slot in its bottom portion.
Figure 8C:
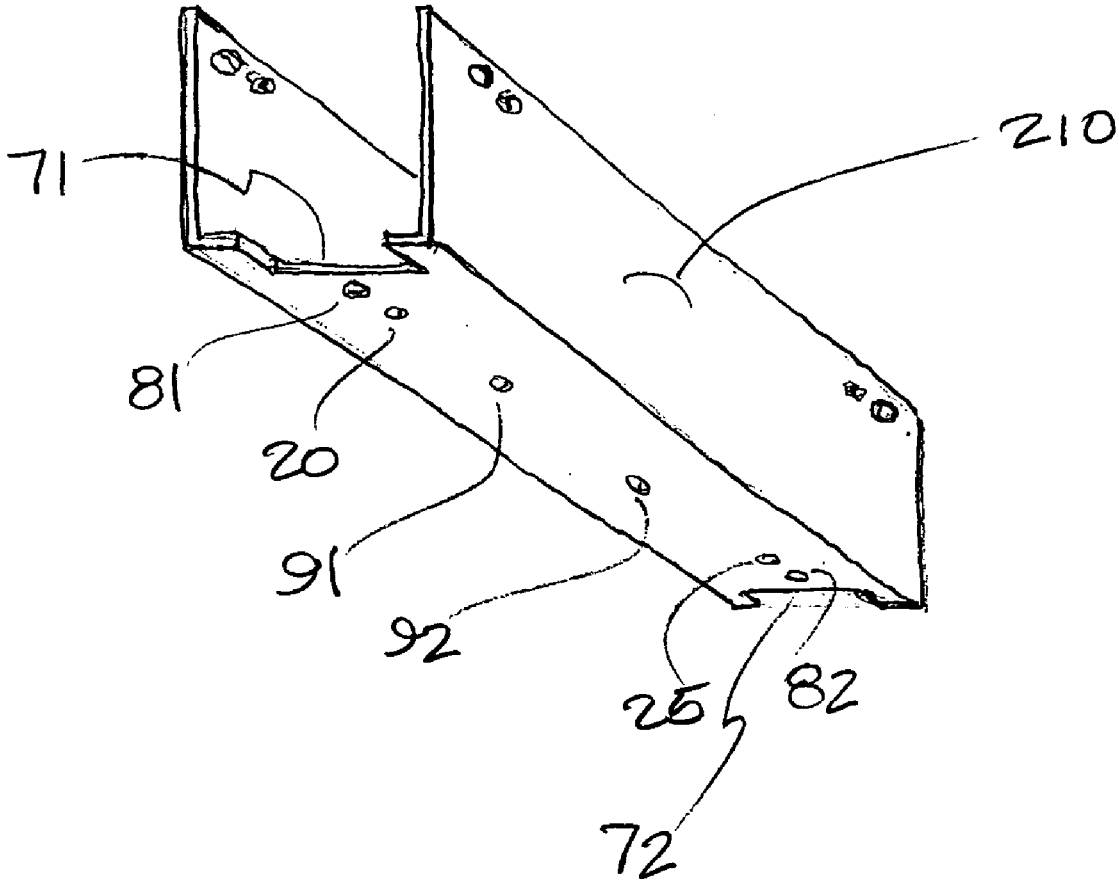
FIG. 8*c* is a view underneath and right of a one-lamp channel showing both socket slots in its bottom.

There are also two single screw-capture holes (20,25) in the bottom of the channel; one near each end (hole 25 is not shown in FIG. 2*c*, but is shown in FIG. 8*c*). They are centered in the width of the bottom of the channel, and each is spaced equally away from the end of the channel to which it is nearest. Also, the center-to-center distance between the single holes (20,25) in the bottom of the channel, is the same as the center-to-center distance between the single holes (10,15) in the top of the track.

Winged Hanger

Figure 5A:
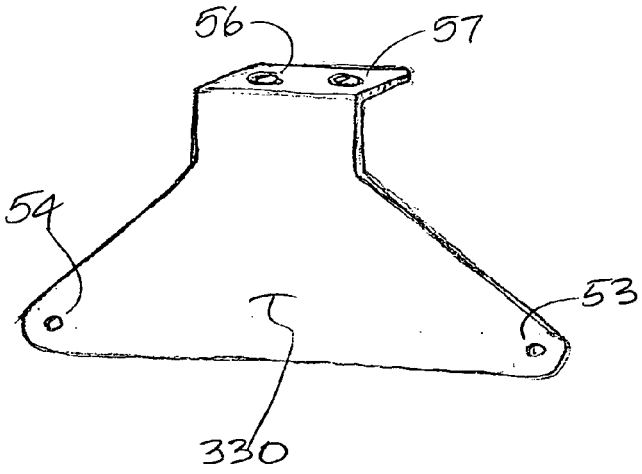
FIG. 5*a* is a front view of a winged hanger.

FIG. 5*a* shows a generally wing-shaped hanger (330) made of thin, stiff material, for hanging luminaire coverings, described below. In profile, it has a square-cornered, inverted-L-shape, and facing, it has a wide-necked, generally triangular vertical front. It has a pair of screw-locating holes (56,57) in its narrow top, and a pair of catch-mounting holes (54,53), in its front, near its bottom left, and bottom right, rounded corners. Catch-mounting holes are smaller than screw-locating holes, but larger than the outer thread diameter of joining screws.

A short, and wide, rectangular neck portion, in the upper portion of the hanger (330), joins the top of the hanger, to the generally triangular lower portion. The neck portion is a little taller than the height inside the mounting track (100). The width of the neck portion, which is the same as the width of the top of the hanger, is a little less than the width inside the track. The length of the top of the hanger is substantially shorter than its width.

The pair of screw-locating holes (56,57) in the top of the hanger (330) is centered in its width, and length. The center-to-center distance between the holes of the pair, is the same as the center-to-center distance between pairs of screw-capture holes in the top of the track, such as the holes (33,34) near the farther end of the track (100) in FIG. 2*b*.

Figure 5B:
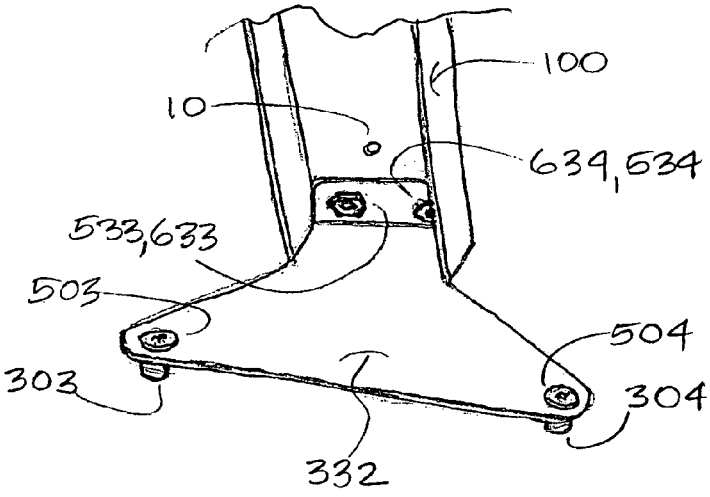
FIG. 5*b* is a view of the back of winged hanger with pegs on its front and shown mounted at the end of a track.

FIG. 5*a* shows an isolated hanger (330), in a view to its front. FIG. 5*b* shows another identical hanger (332), in a view to its back, and attached at the farther end of the mounting track (100), in an underside partial perspective view of the track. It shows the attached hanger (332) fastened to the track with two joining nuts (633,634) threaded onto a pair of joining screws (only the tips of screws 533, 534 are shown), that are installed in holes in the top of the track (33,34 are not shown; they are covered by the hanger) near the farther end, and through the holes in the top of the hanger (56,57 are not shown; they are covered by the screw heads). Joining nuts are self-locking, and are sized and threaded for fastening onto joining screws.

Two peg-mounting screws (503,504) are also shown in FIG. 5*b* installed in the pair of catch-mounting holes (53,54 are not shown; they are covered by the screw heads). Also, a pair of mounted, short, cylindrical, hollow, inside-threaded pegs (303,304), for supporting cover brackets, described below, are partially shown (they protrude from the away face of the hanger).

Figure 5C:
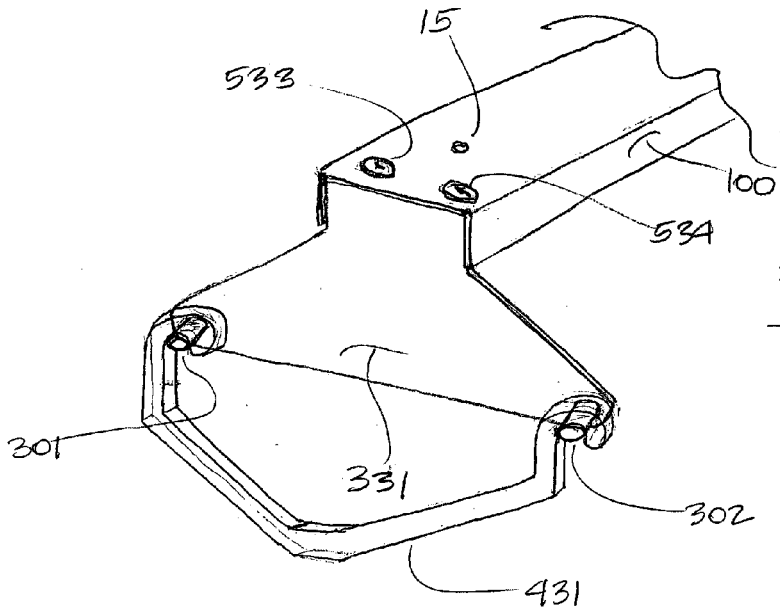
FIG. 5*c* is a front view of winged hanger with pegs shown mounted at the end of track and shown with a cover bracket hanging on its pegs.

FIG. 5*c* shows another identical hanger (331) with pegs, and fastened to the closer end of the track (100), in a partial view to the track which is similar to that in FIG. 2*b*. The two pegs (301,302) are shown mounted on the hanger's face, near its lower corners. All pegs are the same, and each is longer than its diameter.

Figure 6A:
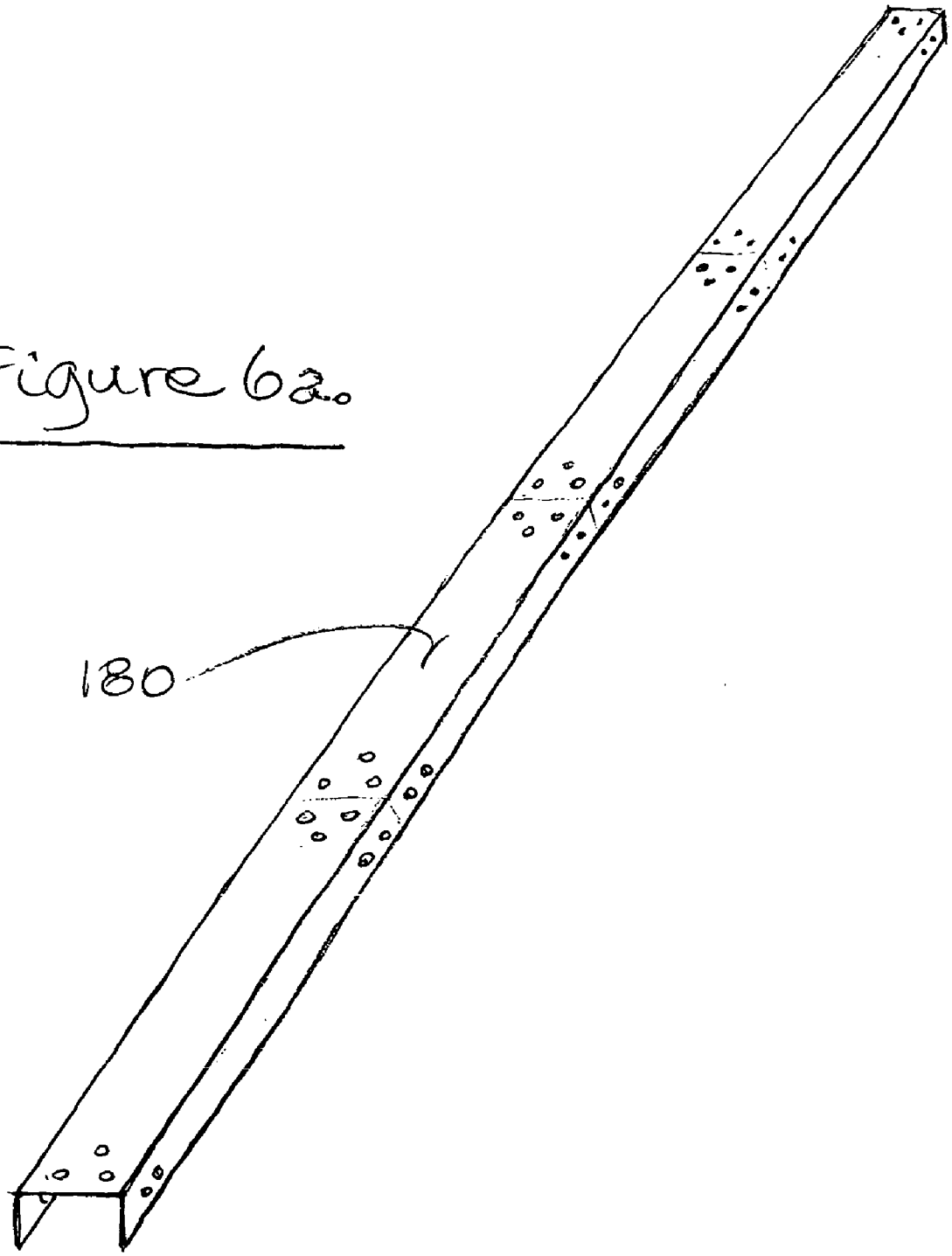
FIG. 6*a* is an elongated view of a continuous-row track from above and right showing four copies of basic track combined in one extended length.
Figure 6B:
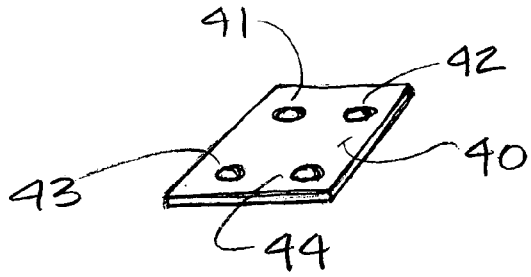
FIG. 6*b* shows a joiner from above and to its right.
Figure 6C:
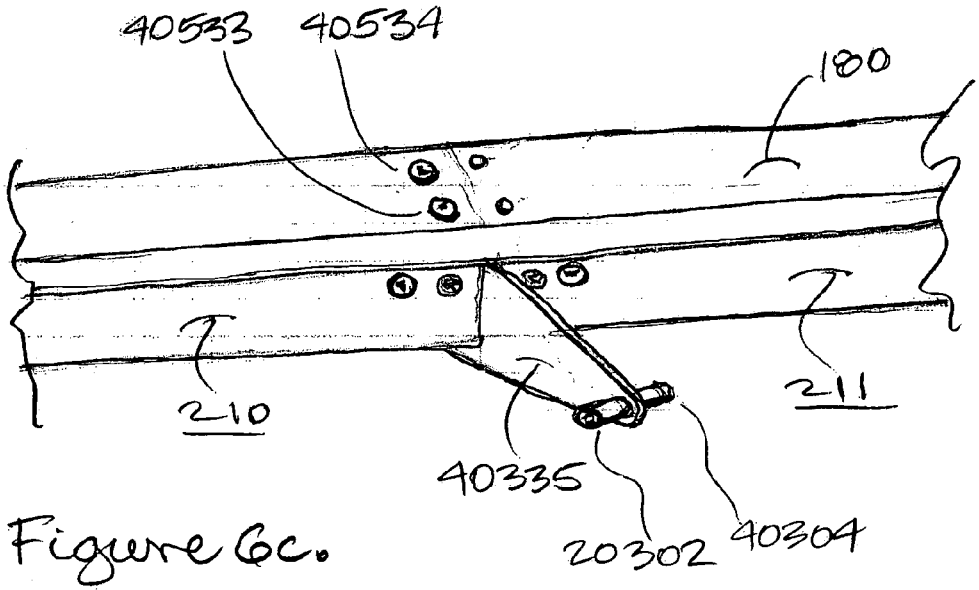
FIG. 6*c* is a view from above a portion of a continuous row housing and toward its right side showing a winged hanger protruding through the gap between the end portions of two adjacent channels.

FIG. 6*c* shows another identical hanger (40335) with pegs on both its faces (20302,40304) on its right side. There are also pegs (not shown) on both its faces on its left side. The hanger is shown extending between and beyond the outside surfaces of two adjacent spanning channels (210,211) that are mounted on a continuous-row track (181) and attached with screws (40533, 40534) that extend through the top of the track and through the screw-capture holes in the top of the hanger and into joining nuts (not shown).

V-shaped Cover Bracket

FIG. 5*c* also shows an isolated, transparent cover bracket (431) hanging from the pair of pegs on the winged hanger (331). The bracket is flat and thick, and its lower portion is generally V-shaped, with a narrow flat bottom. The upper left, and upper right portions, are hooked; each having an inverted-J-shape, and each faces the same way. They are spaced apart the same distance as the pair of pegs (301,302) is on the hanger. The radii of the circular arches inside each of the inverted-J-shaped portions are equal, and slightly greater than half the diameter of any peg.

Figure 10:
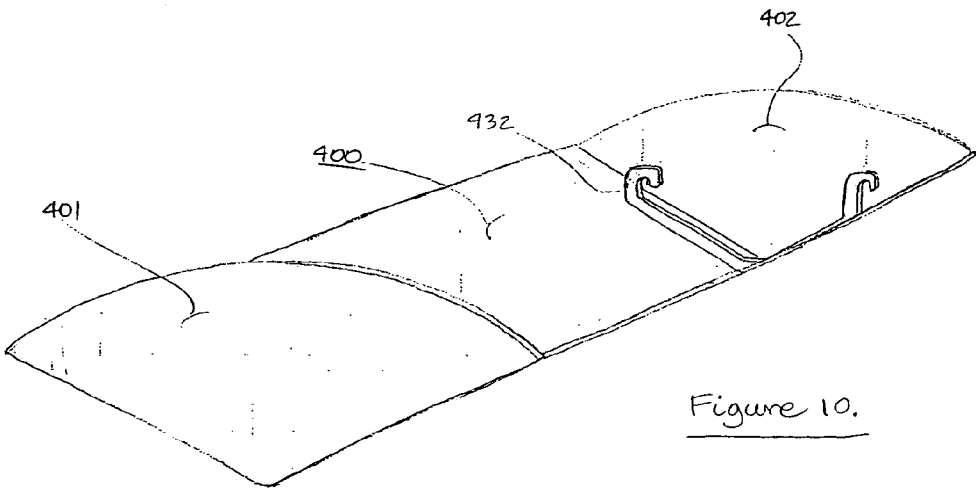
FIG. 10 is a view above and to the right of a V-cover showing incorporated cover brackets.

Overall, the bracket is slightly wider than the overall width of a hanger. The bracket's thickness is less than the length of a peg. FIG. 10 shows another identical cover-bracket (432) bonded near the farther end of the V-shaped cover (400), described below. It has the same size, shape, and orientation as the bracket (431) shown in FIG. 5*c*. The slopes of the left and right lower edges of the brackets, are equal, and the same as the slopes inside the cover (400).

Luminaire Track

Figure 5D:
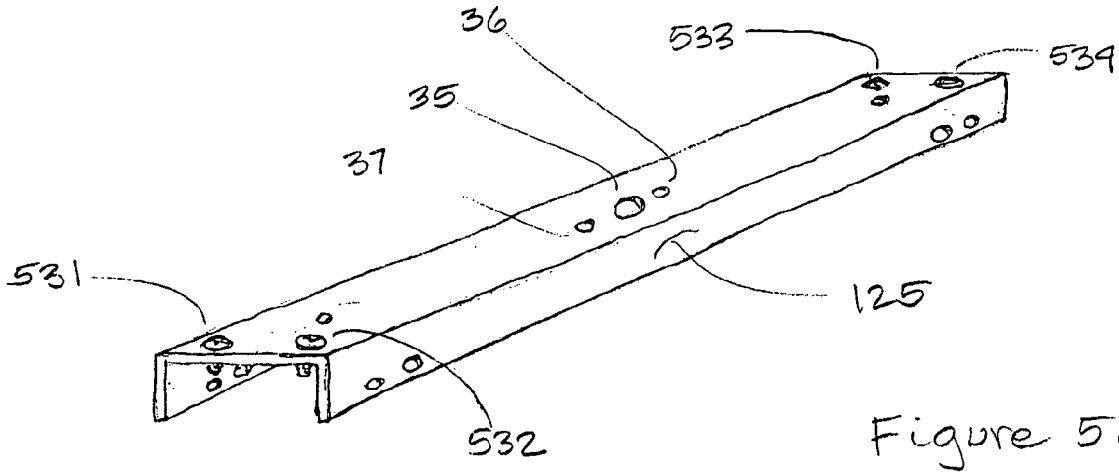
FIG. 5*d* is a perspective view of a luminaire track from above and right.

FIG. 5*d* shows a luminaire track (125), that is identical to the basic track (100), except for three additional holes, in it's top. There is a round, wire-exit hole (35) in the center of the width, and length, of the track's top. Also, there are two screw-capture holes (36,37) for attaching a luminaire-mounting canopy, described below, that are centered in the width of the track's top, and spaced equally away from the wire-exit hole.

Four joining screws (531–534) for attaching hangers, are also shown installed in the top of the track, in the pairs of screw-capture holes (31–34 are not shown; they are covered by the screw heads) near the ends of the top of the track.

Canopy

Figure 5E:
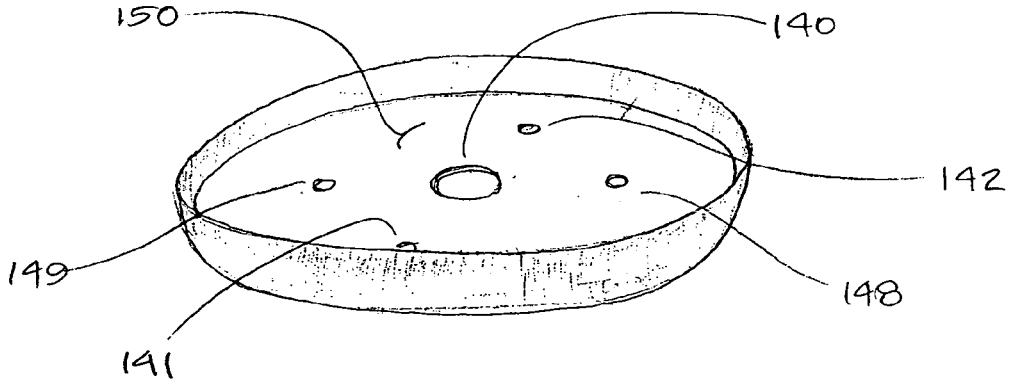
FIG. 5*e* is a view from above and to one side of a canopy used with luminaire track to mount over an electrical lighting outlet box.

FIG. 5*e* shows a round canopy (150), with an upwardly arching, circular rim, for mounting a luminaire. This view from above it reveals a wire-exit hole (140), centered in its flat bottom. Also, there are two spaced-apart pairs of screw-locating holes (141,142 and 149,148) in the bottom of the canopy, centered along two perpendicular lines that intersect the center of the wire-exit hole.

The pair of holes (149,148), that in FIG. 9 are shown substantially equidistant from the viewer, are spaced equally away from the wire-exit hole in the center of the canopy, and apart from one another the distance that matches the pair of spaced apart threaded holes in a standard swiveling crossbar (not shown) for hanging light fixtures.

Figure 11:
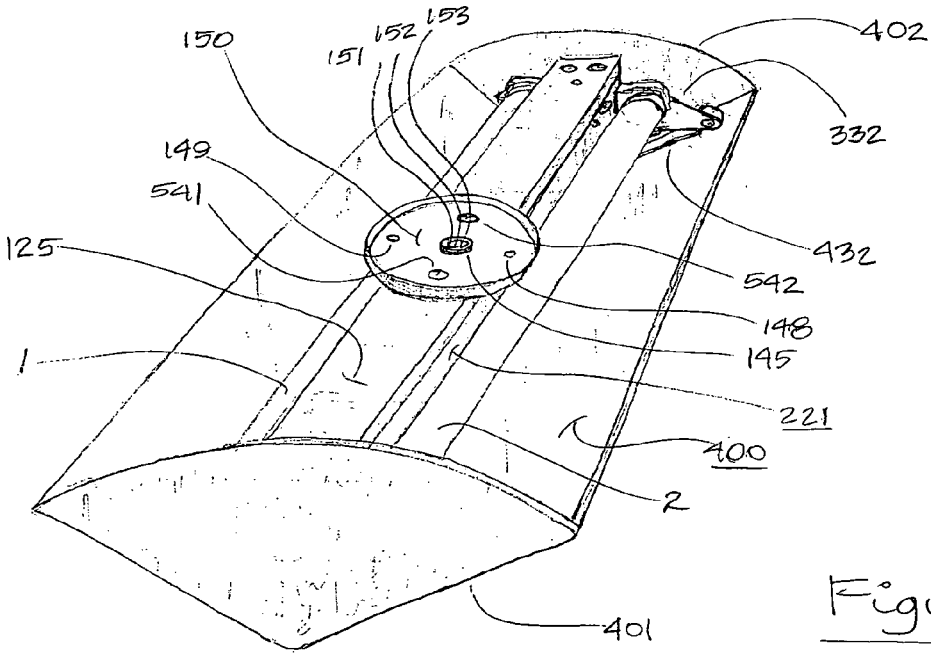
FIG. 11 shows a complete luminaire with two fluorescent lamps and a V-shaped cover as seen from above and over one end of luminaire.

FIG. 11 shows the canopy (150) on a luminaire track (125). It is fastened thereon with two joining screws (541, 542), using the pair of screw-locating holes (141,142 are not shown) in the canopy, that in FIG. 5*e* are shown respectively, closer to, and farther from, the viewer. The holes in this pair are spaced equally away from the center of the wire-exit hole, and apart from one another the same distance as the holes (36,37) in the middle of the top of the modified mounting track (125).

Continuous-Row Track

FIG. 6*a* shows a continuous-row mounting track (180), comprising one contiguous track that is identical to four replications of the basic track (100) wedded end-to-end. A plurality of continuous-row tracks may be joined together, and in combinations with basic tracks, or incremental lengths of row track, using joiners described below, to form a row of virtually any incremental length.

Joiner

FIG. 6*b* shows a flat, rectangular joiner (40) that is slightly narrower than the inside width of any mounting track, and that is a little longer than it is wide. There is a pair of screw-locating holes (43,44) near the closer edge in the joiner, and another pair (41,42) near its farther edge. The center-to-center distance between each hole in the pair, is the same as the center-to-center distance between each pair of screw-capture holes in the top of the basic mounting track (100), such as the closer pair (31,32) in FIG. 2*b*. The center-to-center distance, between the closer and farther pairs of holes in the joiner, is equal to twice the distance, from an end of the basic track, to the center of a screw-capture hole nearest that end, on top of the track, such as either hole in the closer pair (31,32) in FIG. 2*b*.

Lamp Channels

FIG. 8*a* shows a two-lamp channel (220), which is substantially the same as the basic channel (200), but with taller sides, and some additional features. The lamp channel has pairs of rectangular-shaped slots, one at each end, for accepting lamp sockets that hold fluorescent lamps. The two-lamp channel has four slots (76–79; 77 is not shown); a pair in its left side, and another pair in its right side, and they are all spaced equally below the upper edges of the channel's sides.

FIGS. 8*b* and 8*c* show a one-lamp channel (210), having sides with heights the same as the basic channel's sides, and with only two slots (71,72) centered in the width of its bottom (72 is not shown in FIG. 8*b*); one at each end of the channel. All slots have the same size and shape.

In addition, there are engagement holes adjacent each slot, for securing lamp sockets in place. There are four holes (86–89) in the two-lamp channel (220), shown in FIG. 8*a* (87 is not shown), and two holes (81,82) in the one-lamp channel (210), shown in FIG. 8*c*. Each engagement hole is centered relative to respectively the height, or width, of its adjacent slot, and each hole is spaced equally away from the end of the channel to which it is nearest. The diameter of any engagement hole is slightly larger than the outer diameter of the engagement pin on any lamp socket.

Figure 8D:
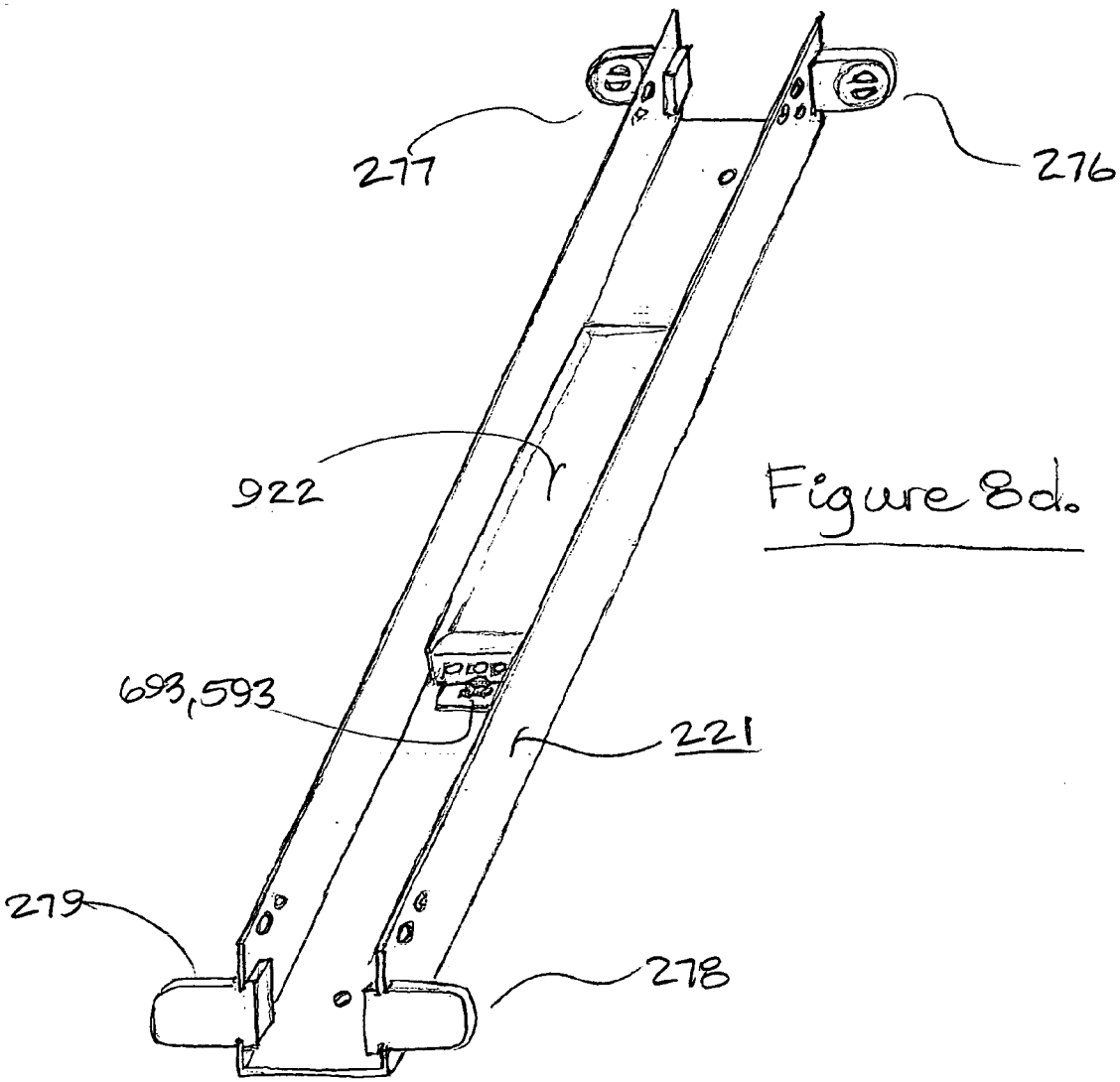
FIG. 8*d* is a view from right and above into a two-lamp channel showing ballast and sockets for fluorescent lamps.

FIG. 8*d* shows another two-lamp channel (221), with installed components. Two pairs of lamp sockets, installed in the four slots in the channel, oppose each other over the length of the channel. There are a pair of sockets in its left side (277,279) and another pair in its right side (276,278). Each socket has a notch, in each of its two lower side edges, that engages with the two opposing shorter edges of any slot in any channel. The sockets (279,278) shown at the closer end of the channel illustrate this.

FIG. 8*c* shows the underside of a one-lamp channel (210), with a pair of screw-capture holes (91,92) in its bottom for mounting a ballast. The pair of holes is centered in the channel's width and length. The center-to-center distance between each hole of the pair, is the same as the industry standard for ballast mounting centers.

An installed two-lamp ballast (922) is also shown in FIG. 8*d*. For clarity, it is shown without the wiring that would interconnect it with the sockets (276–279) installed in the channel. It is fastened to the two-lamp channel (221) with two joining nuts (693,694; 694 is not shown). Each joining nut is fastened onto one of the joining screws (only the tip of screw 593 is shown, and 594 is not shown), installed in the pair of screw-capture holes (not shown), in the channel's bottom. The screw-capture holes for securing the ballast are also centered in the channel's width and length, like those in the bottom of the one-lamp channel (91,92) shown in FIG. 8*c*. Components may be similarly installed in one-lamp channels and in spanning channels.

Spanning Channels

Figure 7A:
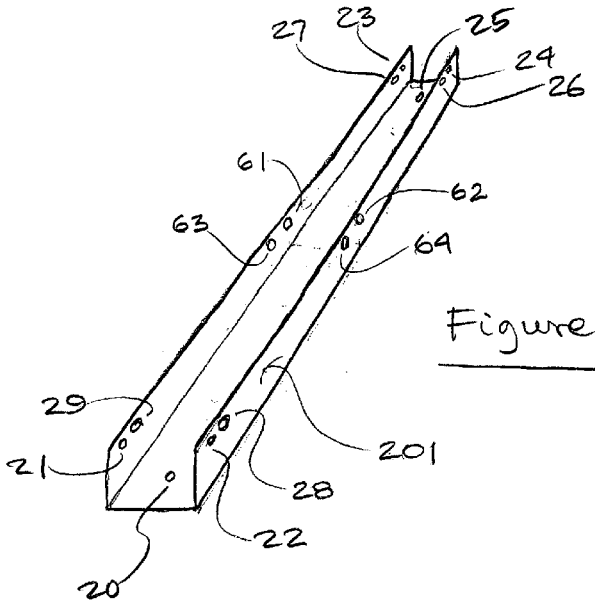
FIG. 7*a* is showing the doubled length of a spanning channel in a view from above and right.
Figure 7B:
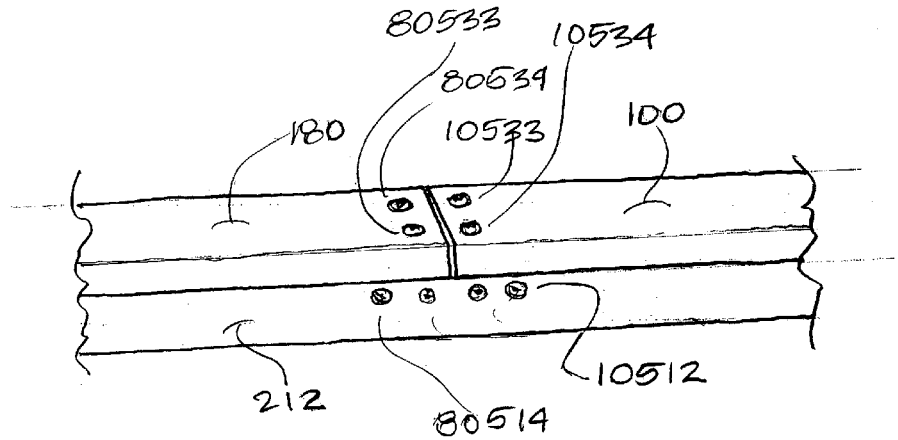
FIG. 7*b* is a view from above a portion of a continuous row housing and toward its right side showing the end portions of two joined tracks and the middle portion of a spanning channel reinforcing the joint.

Portions of two identical one-lamp spanning channels (211, 212) are shown in FIGS. 6*c*, and 7*b*, respectively. Lamp spanning channels resemble spanning channels in every respect except for the addition of socket slots with engagement holes at each end that are identical with those shown for the one-lamp channel (210) in FIG. 8*c*. From the perspective in FIGS. 6*c* and 7*b*, the socket slots with their engagement holes, on the bottom and at the ends of these channels, are not visible.

While an two-lamp spanning channel is not shown, its features can be derived from the channels that are shown in other figures. Its sides have the same height, and the ends of its sides have socket slots with engagement holes, as on a two-lamp channel, such as on channel (220) shown in FIG. 8*a*. Its length is the same as the length of a spanning channel, and screw capture holes along the upper edges of its sides are the same as on a spanning channel, such as shown on channel (201) in FIG. 7*a*.

Continuous Row Housing

A housing of virtually any length can be assembled using joiners, and various combinations of one or more basic tracks, continuous-row tracks, one- or two-lamp channels, and one- or two-lamp spanning channels. Appendages, for example hangers, that support coverings, may be periodically attached along the tracks, and allowed to project beyond the space enclosed by the housing, in the gaps between adjacent channels, as shown in FIG. 6*c*. In the case of lamp channels using fluorescent lamps, this means that coverings will be supported in an area where they will not block light from lamps installed in the luminaire. Extensible luminaire housings with or without appendages, can be placed in narrow architectural coves, avoiding the extensive labor otherwise required to install lighting into the cove.

As shown in FIG. 6*c*, a one-lamp channel (210), and a one-lamp spanning channel (211), each abut a winged hanger (40335). The hanger is fastened to a continuous-row track (180) using joiner screws (40533, 40534) that extend through the top of the track and through the top of the hanger inside the housing and into two joining nuts (not shown). Near the middle portion shown of the continuous-row track (180), the one-lamp channel (210) is fastened to the left of the hanger (40335), and the one-lamp spanning channel (211) is fastened to the right of the hanger. Note that the assembly constrains collinear alignment of the channels (210, 211) with each other and with the track (180).

Two abutted tracks (181, 100) are joined, as shown in FIG. 7*b*, using joining screws (80533, 80534, 10533, 10534) that extend through the tops of the tracks and through a joiner inside the housing and into four joining nuts (not shown). A one-lamp spanning channel (212) fastens to the tracks with joining screws (80514, 10512) shown on its right side, and two more on its left side (not shown). Note that these screws cover screw-capture holes (61–64 not shown) in the middle portion of the upper edges of the sides of the one-lamp spanning channel (212), and that the assembly constrains collinear alignment of the tracks (180, 100) with each other and with the channel (212).

Alternate Hanger and Alternate Cover Bracket

Figure 13:
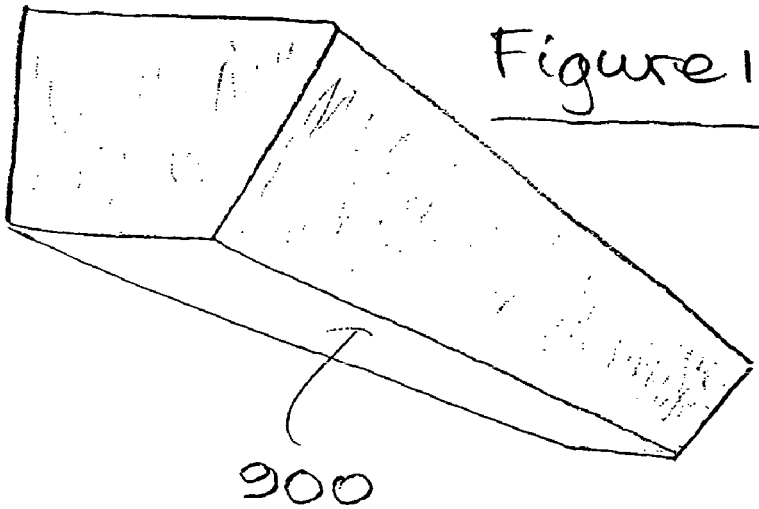
FIG. 13 shows a trapezoidal cover from underneath and to its right.

FIG. 9*a* shows an alternate substantially rectangular shaped hanger (731) with pegs (701,702) on its front engaged with an alternative cover bracket (831) having a sloped edge for joining inside a trapezoidal shaped (900) cover shown in FIG. 13.

Alternate Housing and Alternate Luminous Means

FIG. 9*b* shows an alternate track (1000) employing a ridged edge to engage with an alternate channel (2000) that has a curved surface and a grooved edge for engaging the track, and wherein the channel has numerous tightly spaced holes in a line for accepting light emitting diodes.

V-shaped Cover

FIG. 10 shows a V-shaped cover (400), apart from its associated housing and lamps. The cover has a generally V-shaped cross-section, with a slightly rounded bottom edge, and is otherwise thin and flat over its length. The length of the cover is a little longer than the length of a basic housing, which can be appreciated in FIG. 11. The cover is wider, from its left side upper edge, to its right side upper edge, than either cover-bracket (431,432) bonded to it, near each of its ends (431 is not shown).

Figure 12:
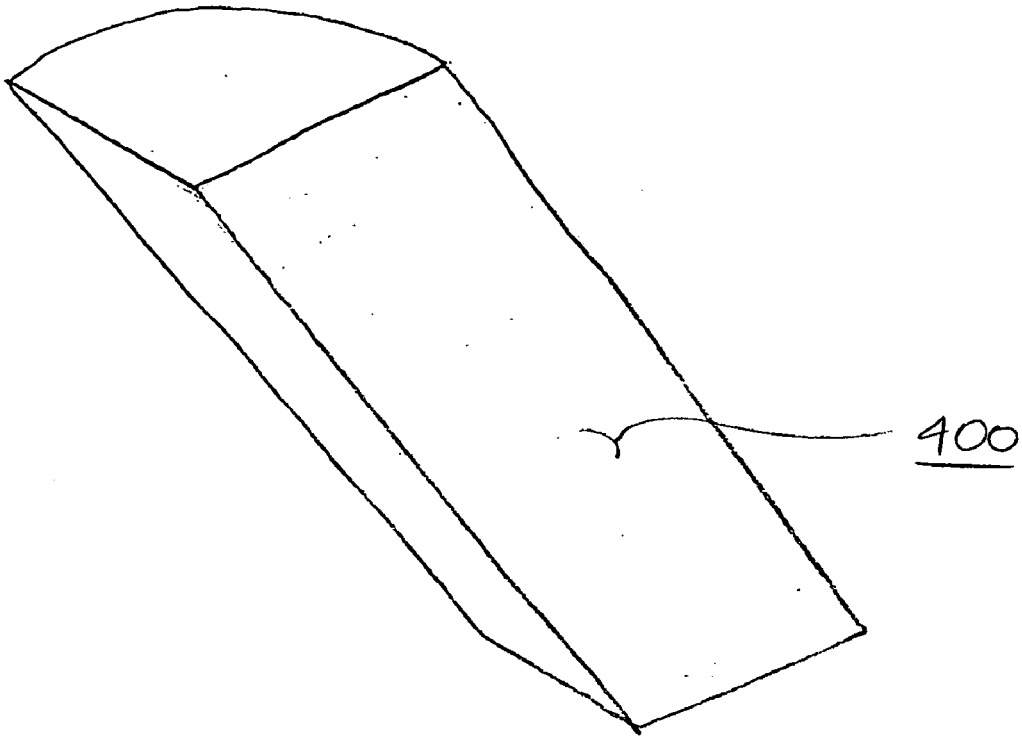
FIG. 12 shows a V-shaped cover from underneath and to its right.

A flat, thin end-cap (401) is shown bonded to the closer edge of the cover (400) in FIGS. 10, 11, and 12. FIGS. 10 and 11 also show another substantially similar end-cap (402) bonded to the farther edge of the cover. The lower edges of the end-caps have the same shape as the generally V-shaped edges at the closer and farther ends of the cover. The end-caps also have an upwardly arched, upper portion. The height of an end-cap is less than its width.

In FIG. 11, the cover (400) is hung by its two cover-brackets (431,432; 431 is not shown), and from the two hangers (331,332; 331 is not shown) attached to an assembled two-lamp housing (105,221), that is also shown with two lamps (1,2) installed. Either radius, taken perpendicular from the bottom edge of the cover, to the top edge of the upwardly arched portion of either end-cap (401,402), is greater than any perpendicular radius from the bottom edge of the cover, to any part of the top of the mounting track (100); thus the housing is hidden from views toward either end of the luminaire. Also, each upper side edge of the cover (400) lies in a plane that is substantially common with the plane containing the central axes of the tubular lamps (1,2) installed in the luminaire, and a substantial portion of light produced by these lamps is unblocked by the cover.

V-cover Luminaire

FIG. 11 shows one example of a complete luminaire in a view from above it. It employs the translucent, V-shaped cover (400), with incorporated end-caps (401, 402), and cover-brackets (431,432; 431 is not shown). This view reveals portions of the lamps (1,2) installed in the luminaire, a portion of the assembled housing (125,221), and a portion of the farther hanger (332). The closer hanger (331 is not shown; it is behind the endcap) and the farther hanger each support one of the cover-brackets that are a part of the cover (400). A small portion of the farther cover-bracket (432) is shown in front of the farther end-cap (402), and behind the farther hanger (332). Cover-bracket (432) is hung from two pegs (303,304 are not shown) on the farther hanger (332).

A canopy (150) is shown attached to the housing's mounting track (125) with two joining screws, and three power supply wires (151–153) are shown emerging from a hollow bushing (145) installed in the concentric wire-exit holes (35,140 are not shown) in the top of the modified track, and bottom of the canopy. The luminaire is operable to radiate light from along its length in a combination of direct light modified by its cover, and indirect light reflected from a surface when mounted under same, and when energized.

FIG. 12 shows an ordinary view of the luminaire, from below and to the right of its cover (400), as the luminaire might appear mounted on the ceiling of a room.

Alternate Wall Mounted Luminaire

FIG. 13 shows an ordinary view of an alternative luminaire, from below and to the right of its cover (900) that has a translucent sloped portion, and a diffuse clear horizontal portion, and transluscent trapezoidal shaped end-caps, as the luminaire might appear mounted on the wall of a room, such as above a mirror for a vanity.

While the above descriptions contain many specifics, the reader should not construe these as limitations on the scope of the invention, but merely examples of the embodiments thereof. Those skilled in the art will envision many other variations that are within its scope.

For example, the track and channel can alternately be joined with a screw inserted into the single holes near each end and on the bottom of a channel, that is threaded into a hollow peg mounted over the single hole near each end in the top of a track. The track and channel could be made with curved cross-sections rather than square cornered, or made with numerous other features that permit joining in mutually overlapped configurations. Hangers can be made virtually any shape to accommodate different orientations and shapes of light modifying coverings. Cover brackets can be made of a variety of materials, and attached to covers by numerous means. Coverings can be made of virtually any material, having almost any light modifying properties.

Lamp channels could be made for three or more lamps, or fitted for rows of compact fluorescent lamps, or for rows of light emitting diodes or linear arrays of same, or electroluminescent panels, or even for incandescent lamps. Arrangements could also be made for light to be generated inside the housing, or conveyed into it from a remote location and distributed with optical elements over its surface.

Extensible luminaires used for continuous-row lighting could be designed to overlap by different amounts, can have a variety of supports attached for suspension, or brackets for mounting, and can employ a flexible power cord for mounting in narrow architectural coves fully assembled.

Accordingly, the reader is requested to determine the scope of the invention by the appended claims and their legal equivalents, and not by the examples which have been given.

The invention claimed is:

1. A linearly extensible modular luminaire, comprised of a powered enclosure formed of an assembly of mutually overlapped elongated channel-shaped members, wherein said elongated members colinealy align along both of their longitudinally extended edges, and wherein one elongated member substantially overlaps only a portion of the length of another elongated member, said members being thus translationaly offset from one another, and together forming an enclosed region over the portions of their lengths so overlapped when interlocked, fastened, or otherwise joined together, and wherein the translationaly offset portions of the assembly that remained not overlapped are interlocked with, fastened to, or otherwise joined with additional elongated channel-shaped members made in length substantially equal to said remainder, and wherein joining members may also be used between some adjacent members, and wherein planar members may partition the region enclosed by said assembly, or close the ends of said assembly, and where provision is made for interconnections inside said enclosure to connect with an outside source of power, and wherein said enclosure is made with operable luminous means, including but not limited to having one or more lampholders and wiring, or light sources with energizing components and wiring, or light conveying and distributing means, or combinations thereof, that are operable when connected to an outside source of power to radiate light from along one or more axes, comprising:

an elongated first member that has a top portion and two spaced apart side portions, together uniform in length, forming an nominally inverted-U-shaped channel, having also means along its top sides or lower edges for interlocking with, being fastened to, or otherwise joining with another similarly shaped elongated member, first member having also provision near its ends for interlocking with, fastening to, or otherwise joining with an joining member, and first member having provision along its top for interlocking with, fastening to, or otherwise joining with another member made planar and with a substantially perpendicular mounting means, in locations along its length that are strategically placed to allow said planar member to occupy space between other elongated members when assembled in said enclosure;

an elongated second member, with incorporated luminous means, that has a bottom portion and two spaced apart side portions, together uniform in length substantially the same as the length of said first member, or made slightly less, forming an nominally U-shaped channel with width substantially the same as first member, second member having also means along its bottom sides or upper edges for interlocking with, being fastened to, or otherwise joining with said first member, and when translationaly offset from same;

an elongated third member that is nominally the same as said first elongated member but made in length equal to the difference between the length of an first member and the length over which first and second members overlap when they are interlocked, fastened, or otherwise joined together translationally offset from one another;

an elongated fourth member, with incorporated luminous means, that is nominally the same as said second elongated member but made in length equal to, or a little less than, the difference between the length of an second member and the length over which first and second members overlap when interlocked, fastened, or are otherwise joined together translationally offset from one another;

an joining member, made bounded by the inside surface of said first member, that may be used to join together first members, or join said third and first members, utilizing the provision made near the ends of said members, and made to minimize its obstruction of the interior of said powered enclosure when so incorporated;

an solid planar member with means to interlock with, fasten to, or otherwise join with said first or third member nominally perpendicular to same, and shaped bounded by the inside surfaces of first member, and planarly extending to, or beyond the outside surfaces of said second member when incorporated in said enclosure, also with means incorporated for supporting or fastening with auxiliary components, when said member planarly extends beyond the outside surfaces of said second member;

an planar member with means to interlock with, fasten to, or otherwise join with said first member nominally perpendicular to same, and shaped bounded by the inside surfaces of first member, and planarly extending to or beyond the outside surfaces of said second member, where incorporated in said enclosure, and having also an opening or openings through a part of the region bounded by said inside surfaces of first member, also having means incorporated for supporting or fastening with auxiliary components; when said member planarly extends beyond the outside surfaces of said second member;

the assembly that is formed of a plurality of said first and second members that are mutually overlapped, and wherein all first members are translationaly offset from all second members, with each first member colinealy aligned one end to another, and with each second member colinealy aligned the same, thus forming a substantially enclosed region over their combined lengths where so overlapped;

the assembly that is formed of one said third member, or one said fourth member, or one third and one fourth member, and the plurality of said first and second members that are mutually overlapped, wherein all first members are translationaly offset from all second members, and with each first member colinealy aligned one end to another, and with each second member colinealy aligned the same, and with said third member colinealy aligned with an end of the assembled first members where a second member had not been overlapped, and with said fourth member colinealy aligned with an end of the assembled second members where a first member had not been overlapped, thus forming an continuously enclosed region;

the assembly that is formed of two said third members, and the plurality of said first and second members that are mutually overlapped, there being also an excess of one second member in said assembly, wherein all first members are translationaly offset from all second members, and with each first member colinealy aligned one end to another, and with each second member colinealy aligned the same, and with said third members colinealy aligned with each of those ends of the assembled first members where second members had not been overlapped, thus forming an continuously enclosed region;

the assembly that is formed of two said fourth members, and the plurality of said first and second members that are mutually overlapped, there being also an excess of one first, member in said assembly, wherein all first members are translationaly offset from all second mem bers, and with each first member colinealy aligned one end to another, and with each second member colinealy aligned the same, and with said fourth members colinealy aligned with each of those ends of the assembled second members where first members had not been overlapped, thus forming an continuously enclosed region;

the assembly so described herein that also incorporates said solid planar member at each end of said assembly, utilizing the provision made near ends of said first and third members, constituting endplates, that together with assembly comprise an enclosure;

the assembly so described herein that also incorporates said solid planar member at each end of said assembly, and one or more said planar member or members that interlock, fastened to, or otherwise join nominally perpendicular with said first members, and that all extend beyond said outside surfaces of said second members, said solid planar and planar members also having means incorporated for supporting or fastening with auxiliary components, and wherein interconnections inside said enclosure may pass through said planar members, and where provision is also made for their connection to a source of power outside the enclosure.

2. The modular extensible linear luminaire of claim 1 wherein some or all of said channel-shaped members have a substantially square cornered cross-section.

3. The modular extensible linear luminaire of claim 1 wherein some or all of said channel-shaped members have a curved cross-section.

4. The extensible linear luminaire of claim 1 wherein fluorescent tube lampholders are incorporated into a surface or surfaces of one or more said second or fourth members, for mounting one or more lamps over the outside of said surface or surfaces, and wherein one or more ballasts are incorporated on an inside surface of one or more second or fourth members for operating said lamps, with interconnecting wiring inside said enclosure.

5. The extensible linear luminaire of claim 1 wherein light emitting diodes are incorporated in lines, or linear arrays across a surface or surfaces of one or more said second or fourth members, and wherein one or more energizing components are incorporated on an inside surface of one or more second or fourth members, with interconnecting wiring inside said enclosure.

6. The extensible linear luminaire of claim 1 wherein compact fluorescent lampholders are incorporated into a surface or surfaces of one or more said second or fourth members, for mounting one or more lamps over the outside of said surface or surfaces, and wherein one or more ballasts are incorporated on an inside surface of one or more second or fourth members, for operating said lamp or lamps, with interconnecting wiring inside said enclosure.

7. The extensible linear luminaire of claim 1 wherein light bulb sockets are incorporated in rows on a surface or surfaces of one or more said second or fourth members, with interconnecting wiring inside said enclosure.

8. The extensible linear luminaire of claim 1 wherein the light source and energizing components are mounted on a surface or surfaces inside one or more second or fourth members, with interconnecting wiring inside said enclosure, and where an optical means, single or plural, conveys light to distribution members mounted over its outside surface or surfaces.

9. The extensible linear luminaire of claim 1 wherein the light source and energizing components are mounted remotely outside said enclosure and and wherein an single or plural optical means conveys or convey light through said enclosure, and into or onto light distribution members mounted over its outside surface or surfaces.

10. The extensible linear luminaire of claim 1 wherein light modifying coverings are partially or fully interposed between the luminaire and the environment that is intended to be lit, using the means incorporated with said solid planar members, and planar members, for supporting or fastening with auxiliary members.

11. An modular customizable luminaire comprising the powered enclosure of claim 1 without said third or fourth or joining members, and wherein only one modified said first member and one said second member interlock, fasten to, or otherwise join with one another aligned completely over their lengths, and with an solid planar member at each end forming an enclosure with interconnections inside, and with operable luminous means incorporated with said second member, operable when connected to an outside source of power to radiate light from along one or more axes, comprising:

an modified first member that has a top portion and two spaced apart side portions, together uniform in length, forming an nominally inverted-U-shaped channel, having also means along its top sides or lower edges for interlocking with, being fastened to, or otherwise joining with another similarly shaped elongated member, first member having also provision near its ends for interlocking with, fastening to, or otherwise joining with an planar member, and first member having means in its top portion for interconnections inside said enclosure to connect with an outside source of power;

an elongated second member, with incorporated luminous means, that has a bottom portion and two spaced apart side portions, together uniform in length and slightly shorter than the length of said first member, forming an nominally U-shaped channel with width substantially the same as first member, second member having also operable luminous means incorporated, and means along its bottom sides or upper edges for interlocking with, being fastened to, or otherwise joining with said first member when aligned with same;

an solid planar member with means to interlock with, fasten to, or otherwise join with said first member nominally perpendicular to same, and shaped bounded by the inside surfaces of first member, and planarly extending beyond the outside surfaces of said second member when incorporated in said enclosure, said solid planar member also having means incorporated for supporting or fastening with auxiliary components;

the assembly of one said modified first member with one said second member with incorporated operable luminous means, and with solid planar members attached nominally perpendicular at each end of said enclosure with interconnections inside, and with solid planar members having means incorporated for supporting or fastening to auxiliary members, and operable when connected to an outside source of power to radiate light from along one or more axes.

12. The luminaire in claim 11 wherein some or all of said channel-shaped members have a substantially square cornered cross-section.

13. The luminaire in claim 11 wherein some or all of said channel-shaped members have a curved cross-section.

14. The luminaire in claim 11 wherein said modified first member has attached in the center of its top portion a canopy with an opening in its center concentric with an opening through top portion, for mounting said luminaire over a conventional electrical lighting outlet box without supplemental support, and for connecting wiring inside said enclosure with an source of power inside said outlet box.

15. The luminaire in claim 11 wherein light modifying coverings are partially or fully interposed between the light source and the environment to be lit, using the means incorporated with planar members for supporting or fastening with auxiliary members.

* * * * *